US005605333A

United States Patent [19]

Field

[11] Patent Number: 5,605,333

[45] Date of Patent: Feb. 25, 1997

[54] CARD GAME EMPLOYING CARD VALUES TO DETERMINE A WINNING CARD HAND

[76] Inventor: Peter Field, 530 N. 3rd St., Montebelleo, Calif. 90640

[21] Appl. No.: 550,788

[22] Filed: Oct. 31, 1995

[51] Int. Cl.[6] ..... A63F 1/00

[52] U.S. Cl. ..... 273/274; 273/292

[58] Field of Search ..... 273/274, 292, 273/85 CP, 303

[56] References Cited

U.S. PATENT DOCUMENTS 5,098,107 3/1992 Boylan et al. ..... 273/292

5,248,142 1/1993 Breeding ..... 273/292

5,275,416 1/1994 Schorr et al. ..... 273/292

5,452,900 9/1995 Skratulia et al. ..... 273/292

*Primary Examiner*—William M. Pierce

*Attorney, Agent, or Firm*—Erik M. Arnhem

[57] ABSTRACT

A card game is played according to rules that provide point values for the natural cards and face cards in each game participant's hand. The object of the game is to achieve a point total in any one suit coming closest to a target point value without exceeding the target value. The winning hand is the hand that has a point value in any one suit closest to the target value without exceeding the target value.

6 Claims, No Drawings

CARD GAME EMPLOYING CARD VALUES TO DETERMINE A WINNING CARD HAND

BACKGROUND AND SUMMARY OF THE INVENTION

This invention relates to a card game wherein a bank deals five cards to himself and to each of the other players. Each player bets his hand against the bank's hand, similar to the practice used in such games as blackjack and baccarat.

In blackjack and baccarat the object is to have a card hand that has a point total as close as possible to a target value without exceeding that value. In blackjack the target value is twenty one points; in baccarat the target value is nine points.

Point values are assigned to each card, according to the nature of the different cards used in playing the game. Typically, each natural card from two to ten has the value appearing on the card, i.e. from two to ten. Each face card has an assigned value of ten. Each face card has an assigned value of ten; and each ace has a value of one or eleven, at the option of the person holding the card.

The cards in each player's hand are totalled and compared with the point total of the cards in the dealer's hand, to determine each winning hand. As noted above, each winning hand is the hand having the point total closest to the target point total (e.g. twenty one or nine) without exceeding the target point total.

Various patents have issued on variations of the blackjack card game or the baccarat card game.

U.S. Pat. No. 5,314,193, issued to E. Ferrer on May 24 , 1994, discloses a card game wherein fifty six cards are used, namely a standard deck of playing cards plus four "joker" cards. The cards are assigned values, such that each natural card from two through ten has its face value, each face card has a value of one half point, and each joker has a value of one half point. Each player is dealt two cards, with the option of receiving up to two additional cards if the player believes such additional cards will improve his hand.

The object of the game is to have a card hand that totals an integer plus one half point. If two or more players have hands that total an integer plus one half point, the hand with the highest point total is the winner. Thus, a hand totalling nine and one half points is the winner over a hand totalling seven and one half points. The general object of the game is to receive a combination of face cards (or jokers) and high value natural cards totalling an integer plus one half point. Each game is played with a maximum of of four cards per player so that each game is played in a relatively short period of time; the object is to achieve a rapid exchange of money for maximizing the profits of the casino that provides the game facility.

U.S. Pat. No. 5,328,189, granted to M. Malek on Jul. 12, 1994, relates to a card game in which the players simultaneously play two card games, namely the game of Twenty One (Blackjack) and Baccarat. In the game of Twenty One the object is to obtain a combination of cards totalling twenty one or less; the player coming closest to twenty one is the is the winner. In the game of Baccarat the object is to obtain a combination of cards totalling nine (without going over nine); the winner is the player coming closest to nine.

In the gaming system proposed in U.S. Pat. No. 5,328,189, the playing surface has marked areas for cards being played in the Twenty One game, and other marked areas for cards being played in the Baccarat game. Each player is dealt four cards, with the option of receiving a fifth card if he so desires. Each player places his cards in the marked areas on the game surface, according to his estimation of his best chance for winning both games (Twenty One and Baccarat). The object is to win both games by the wisest placement of the cards. The game rules include provisions, whereby each player can play against the banker (casino), and (optionally) the other players.

U.S. Pat. No. 5,366,228, issued to A. Kangsanaraks, relates to a card game wherein a standard deck of fifty two playing cards is used. Each natural card, from the ace through the nine, is counted at its face value, and each ten and each face card is counted as zero.

Each player plays against the dealer or banker, with the winner being the person having the highest card total, not exceeding nine.

Each player received two cards, with the option of receiving additional cards if the total card valuation in the hand is less than nine. The game rules require that when the card total in any hand exceeds nine, the ten points will be substracted from the total. For example if a person's hand contains cards totalling sixteen, the hand will be considered to have a value of six. This feature gives each player a second chance to achieve a hand coming close to the desired valuation of nine.

Each player has the option of wagering additional money, on the possibility that the cards in his hand will be the same suit (i.e. a flush) or that the cards in his hand will be the same valuation (i.e. a pair). The game rules provide various ways for the players to win or lose money, using rules established for poker or baccarat.

U.S. Pat. No. 5,368,305, granted to J. Rodda et al, discloses a card game wherein the object is to acquire cards having a total value coming as close as possible to seven and one half, without exceeding seven and one half. Each player plays against the dealer or banker in casino-type fashion; the person with the highest card total, not exceeding seven and one half, is the winner.

The game is played with a conventional deck of cards, with certain cards removed, namely the eights, nines, tens and jokers; there are thus forty cards in the deck. Each natural card in the deck has its actual value, while each ace has a value of one, and each face card has a value of one half Each player is dealt one card, with the option of receiving additional cards so that he can reach a total card valuation as close as possible to seven and one half. Should the card total in a player's hand exceed seven and one half the player automatically loses the hand and the money wagered on the hand.

U.S. Pat. No. 5,397,128, to M. A. Hesse, deals with a variation of the game of baccarat, wherein the players are allowed to draw three (or more) cards. The face cards count as zero, and the numbered cards have their face values. When the card total in any hand exceeds ten, then the total is reduced by ten; e.g. a hand totalling seventeen is counted as seven. Each player plays against the dealer or house; the winning hand is the hand having a point total closest to nine.

The present invention relates to a card game wherein the playing cards include a full complement of face cards, and a partial complement of the natural (numbered) cards. Selected ones of the natural cards are removed from the playing deck; in one particular game according to the invention the fours and fives are removed from the deck.

The rules for playing the card game, assign different numerical values to the cards, according to the identity of the card. Each natural card, from the ace to the nine has the value appearing on the card, i.e. from one to nine. Each ten and each face card has a zero point value.

The game is played by a process that comprises the bank dealing five cards to himself and each player. Each game participant (bank or player) arranges his cards in separate groups, according to the different suits. For example, cards in the spade suit form one group; similarly, cards in the other three suits (hearts, diamonds or clubs) form three other groups.

The object of the game is to achieve a hand wherein the total point value in any given suit comes as close as possible to a specified target point value without exceeding that value. Each player bets his hand against the hand of the dealer. The winning hand (as between the bank and each player) is the hand having a single suit total point value as close as possible to the target value without exceeding that value. In one particular embodiment of the invention, the target point value is set at five points.

A distinguishing feature of the invention is that the cards in each hand are subdivided into groups according to their respective suits (spades, hearts, diamonds or clubs). The point values for the cards in each group are totalled and compared with the target point value (e.g. five points) to determine a winning hand (bank versus each player).

Each game participant has four different opportunities to achieve a winning hand (because a winning total can be achieved in any one of the four suits). For example, a game participant might have a hand that includes the two and three in any one of the four suits. The point total of five could be a winner in any one of the four suits.

As an option, or variant, of the invention, the rules can provide for other ways to achieve a winning hand. For example, the rules can specify that a hand wherein all five cards are the same suit, can be a winning hand irrespective of the card point total in any one suit. Other variants on the inventive concept can be used, to increase the number of ways in which a winning hand can be achieved.

The game can be played on any appropriate table surface, e.g. a semi-circular table surface as shown in aforementioned U.S. Pat. No. 5,368,305 or U.S. Pat. No. 5,328,189. As depicted in those patents, the semi-circular table surface is designed so that the players sit in a semi-circle facing the bank, such that the bank is able to easily reach the table area in front of each player for purposes of dealing cards and retrieving poker chips or other betting tokens used in playing the card game.

The game of the present invention is playable on any suitable playing surface, using specific combinations of commercially available playing cards. Since conventional game materials are used, the present disclosure does not include drawings of specific game materials or arrangements used in practice of the invention.

DESCRIPTION OF A PREFERRED EMBODIMENT OF THE INVENTION

In one specific embodiment of the invention the game uses a playing deck of cards comprised of eight conventional decks of cards in which all of the jokers, fours and fives have been removed. The game deck then consists of playing cards that include the aces, all of the natural cards (except the fours and fives), and all of the face (picture) cards. The game cards are shuffled and preferably placed in a shoe for dealing.

The game can be played on any table surface. However, the preferred game surface is a Super Pan 9 surface or Asian poker table, wherein the players are arranged in a semi-circl around the dealer. The game can be played by any number of participants, limited to the number of seats available at the table each betting against the bank. Typically, there will be seven or eight players (and one bank).

The bank can be a person employed or designated by the casino or other establishment conducting the game. The bank controls or handles the bank where permitted by law; otherwise, one of the front-line players is designated as the bank.

Different rules can be established to limit the dollar amounts bet on each game. For example, the rules can limit the betting to a maximum of one hundred dollars (or any particular amount) per player bet on each game. Each player places his bet on the table surface prior to the cards being dealt.

Each ace has a value of one point, each natural card has the value indicated on the particular card and each face card has a value of zero.

Each game participant is dealt five cards, using various dealing procedures. For example, each game participant can receive all five cards at one time (i.e. without intervening cards going to other game participants). Alternately, the cards can be dealt around the table until all of the game participants (including the bank) receive five cards.

Each player arranges his cards face up, with the cards in each suit being grouped together; all of the spade cards form one group, all of the heart cards form a second group, all of the diamond cards form a third group, and all of the club cards form a fourth group. If the player does not receive cards in one or more suits then, of course, the number of separate groups is reduced accordingly.

When all of the players have turned their cards face up, in the suit groupings, any player having a zero or a one as his /her highest hand may ask for SHIELD (insurance shielding his/her bet). Shielding relinquishes half the wager to the bank, instead of chancing the loss of the total wager. Shielded playes may remove the remainder of the wager from his/her wagering circle. Any backline player has the option to Shield or play the hand. The dealer turns his cards up in a similar fashion, such that all cards in play are exposed Each player plays his hand against the bank's hand, (or dealer, where permitted by law) such that it becomes possible for the bank to win some hands while losing the other hands during any given game.

The object of the game is to achieve a final total point value in any one suit closest to predetermined known target value without exceeding said target value. The target value used in this illustrative game is five. If the bank's hand has a final total point value in any one suit closer to the target value than the player's total value in any one suit, then the Bank wins the hand. The reverse is true if the player's hand has a total value in any one suit closer to the target value than the corresponding point value in the bank's hand.

In order to increase interest, and improve the possibilities for winning, the rules provide that when the total point value of the cards in any one suit exceed ten, then the suit point value will arbitrarily be reduced by ten. For example if a hand (five cards held by one participant) contains a six of spades, and an eight of spades, the point value for the spade suit in that hand will be four (i.e. fourteen minus ten).

Each game participant (bank or player) can accumulate points in different suits, to achieve a winning hand. For example, the Bank might achieve a winning point total in spades or hearts, or diamonds or clubs.

To illustrate how the game is played, we assume that the bank's hand contains the two of spades, the three of spades, the seven of hearts, the king of diamonds, and the ace of clubs. We will also assume that the player's hand contains the seven of spades, the three of hearts, the ace of hearts, the nine of clubs and the two of clubs.

The bank's hand has five points in spades, seven points in hearts, zero points in diamonds, and one point in clubs.

The player's hand has seven points in spades, four points in hearts, zero points in diamonds, and one point in clubs (nine plus two minus ten).

The bank has the winning hand because the bank's five points in spades is closer to the target value of five points than the player's four points in hearts. In determining the winning hand point values in any given suit totalling more than five are disregarded because they exceed target value. Thus in the illustrative case, the bank's seven points in hearts, and the player's seven points in spades, are disregarded, when determing the winning hand.

It will be seen that the game participant (bank or player) can win in any one of four suits, i.e. spades, hearts, diamonds or clubs. The determining factor is the point total in any one suit. Thus a point total of four in diamonds will beat a point total of three in any suit (spades, hearts, diamonds or clubs).

It will also be seen that it is not essential to hold low cards in any one suit in order to win. For example, a hand containing the seven of hearts and the eight of hearts can be a winner, since the point total in any suit is reduced by ten when the suit point total exceeds ten; in the particular illustration the point total in hearts is five (i.e. seven plus eight minus ten).

The winning hand does not have to have a point total in any one suit of five. Lower point totals can be winning hands. For example, a hand having a point total of four in diamonds will be a winner over a hand having a point total of three in spades (or any other suit).

A principle feature of interest as regards this game, is the fact that a player has multiple ways of winning, i.e. he can win with appropriate point totals in any one of the four suits.

In the event that the bank and player have hands with the same suit point totals, e.g. four points, the game is declared a draw or "push". No money bets are paid.

Various additional rules may be put in place, in order to increase the player interest and ways of winning. For example, the rules may provide that if a participant is dealt five cards of the same suit, the hand is an automatic winner irrespective of the suit point values for that hand. This feature turns an otherwise losing hand into a winning hand. Other winning hands can be provided by setting up appropriate rules, e.g. making hands containing a straight.

In the illustrated game the target point total is set at five. Also, the game playing cards have all fives and all fours removed. This feature makes it more difficult for a game participant to win with a single card, i.e. a four or five in anyone suit. The object is to have a game in which combinations of cards achieve winning point totals.

Target point totals other than five can be used. For example, a target point total of six or seven can be used. Whatever target point value is used, the playing deck will have the corresponding natural numbered card removed. Thus, if the target point total is six, all sixes in the deck will be removed.

The playing deck can be comprised of any number of conventional decks of cards (with selected natural cards removed). Preferably, a large number of decks of cards are used, to deter the participants from making bets based on card counting practices.

Various rules can be established for selecting the bank, the order of play, and the number of players. For example, the game is played with eight front line players. One of the players is initially designated as the bank; that player retains such designation for a predetermined number of rounds of play (e.g. two rounds of betting. The player can relinquish his bank designation at any time. The bank designation rotates clockwise around the table.

The game is played on a five point system, wherein each twenty dollar bet represents one point. The maximum bet would thus be five points, or $100.00 dollars. The table surface may be marked with multiple circles in front of each player, to allow members of the audience (so-called backline players) to place bets, by placing chips in designated circles.

The rules can provide that the cards be dealt to the players in various different orders or sequences. For example, the rules can provide that the cards be dealt to the players one card per player around the table until each player accumulates five cards; alternately each player can be dealt five cards in sequence, going from one player to the next player until all players have received the necessary five cards.

The order in which the players receive cards can be determined in various ways. For example, the so-called "action player" (or first player to receive cards) can be selected by the roll of dice or the dealing of cards (with the highest total being the designated action player).

As previously explained, each player bets his hand against the bank's hand. The participant (player or bank) having the higher point total in any one suit, without exceeding the target value (e.g. five points) is the winner. In the event of a tie, there is no bet.

It will be understood that while the invention has been explained in terms of one particular embodiment, the invention can be practiced in various forms and arrangements.

What is claimed is:

1. A method of playing e card game, comprising:

(a) determining a target point value, (b) providing a dealer and multiple players, wherein each player plays a dealt card hand against a bank's hand, (c) providing at least one deck, of playing cards having a plurality of suits, containing selected natural cards and a full complement of face cards, (d) dealing five cards to the backhand and to each player and, (e) exposing the cards in each hand to determine the winning hands, (f) determining a point value of the cards of each suit in each hand, such that each suit has a total point value based on the value of the cards of each suit in the particular hand, said point value determined such that when the total point value of the cards in a given suit exceeds ten, then the total point value will be reduced by ten to arrive at a final point value for that suit, such that each selected natural card, from the ace to the nine, has its indicated point value and each ten and each face card has a zero point value, (g) declaring a winning hand to be the hand having the final point value in my one suit closest to the target point value without exceeding said target point value.

2. The method of claim 1, wherein step (c) involves the removal of cards numbered, red four and five from the set of natural cards numbered 1–10 and providing that the aforementioned target point value of step (a) is five.

3. The method of claim 2, wherein step (b) involves providing eight decks of cards totalling three hundred fifty two playing cards.

4. The method of claim 1, wherein each player is required to place a bet on the game outcome prior to step (d).

5. The method of claim 1, wherein step (c) involves the removal of numbered natural cards from said playing cards, wherein the removed cards have the same numerical value as said target point value.

6. The method of claim 5, wherein said target point value of step a is five.

* * * * *